United States Patent [19]

Kilgore

[11] Patent Number: 5,012,867

[45] Date of Patent: May 7, 1991

[54] WELL FLOW CONTROL SYSTEM

[75] Inventor: Marion D. Kilgore, Dallas, Tex.

[73] Assignee: Otis Engineering Corporation, Dallas, Tex.

[21] Appl. No.: 509,179

[22] Filed: Apr. 16, 1990

[51] Int. Cl.[5] ..... F16K 15/04

[52] U.S. Cl. ..... 166/188; 137/71; 137/454.2; 137/533.15; 166/317; 166/325

[58] Field of Search ..... 137/454.2, 515, 515.5, 137/71, 533.15; 166/188, 317, 325, 327

[56] References Cited

U.S. PATENT DOCUMENTS

| | | | |
|---|---|---|---|
| 2,719,768 | 10/1955 | Webber | 166/202 |
| 2,854,929 | 10/1958 | McGowen et al. | 166/325 X |
| 3,180,420 | 4/1965 | Manson et al. | 137/454.2 X |
| 3,250,331 | 5/1966 | Boyle | 166/133 |
| 3,473,609 | 10/1969 | Allen | 137/71 |
| 4,352,366 | 10/1982 | Fisher | 137/71 |
| 4,360,063 | 11/1982 | Kilgore | 166/317 |

*Primary Examiner*—Stephen M. Hepperle
*Attorney, Agent, or Firm*—Roland O. Cox

[57] ABSTRACT

A system for controlling flow in a well conduit including a landing nipple in the well conduit and a standing valve, which after landing in the landing nipple may be retrieved or expended from the landing nipple. The standing valve permits upward flow and prevents downward flow through the landing nipple and conduit and has a resilient seal which expands into a groove in the landing nipple to provide limited resistance to upward flow moving the standing valve upwardly out of the landing nipple. Sufficient weight on the standing valve or pumping down the conduit with sufficient pressure releases a landing ring on the standing valve to retract, permitting the standing valve to be moved downwardly and expended out of the landing nipple.

2 Claims, 2 Drawing Sheets

WELL FLOW CONTROL SYSTEM

BACKGROUND

1. Technical Field

This invention pertains to wells and a system for controlling flow in a well flow conduit which utilizes a standing valve. Standing valves are frequently installed in well flow conduits to permit formation fluids to flow into the well flow conduit and upward through the conduit and standing valve to the surface. Standing valves protect well formations from contamination, especially low pressure formations, by preventing fluids in the flow conductor from flowing or being pumped down the flow conduit into the formation.

2. Information

Otis Engineering Corporation Products and Services Catalog (OEC 5516) shows, on page 245, a typical ball-/cage standing valve, used in a retrievable only standing valve assembly, which has been installed in a foot valve in a well flow conduit.

A standing valve embodiment of a lock mandrel is disclosed in copending application for patent, Ser. No. 449,807, filed 13 Dec., 1989 for EXPENDABLE DEVICES FOR WELL LOCK SYSTEM. This lock mandrel is expendable only as it has a lower locking ring, which prevents retrieval and the upper locking ring is retained in expanded position by a retainer ring releasably positioned on the lock mandrel body.

U.S. Pat. No. 4,352,366 discloses a retrievable standing valve having a ball valve which is rotated to close by upward flow through a choke in the ball member. U.S. Pat. No. 4,352,366 is herein incorporated for reference.

SUMMARY OF THE INVENTION

This invention provides a flow control system useful to control flow through a well flow conduit. The system includes a landing nipple in the well conduit and a simplified less costly expendable standing valve installed in the landing nipple. The landing nipple has an internal landing shoulder, seal bore and profiled groove. The standing valve has a through flow passage and a check valve in the flow passage. The check valve permits upward flow and prevents downward flow through the passage and standing valve. The standing valve has a resilient piston unit which seals in the landing nipple bore and expands into the landing nipple groove when the standing valve is installed in the landing nipple. Substantial upward flow through the standing valve is required to develop upward forces sufficient to retract the resilient piston from the nipple groove and move the standing valve upwardly out of the landing nipple. The standing valve also has a retractible landing ring releasably positioned in expanded position which lands on the landing nipple shoulder to stop downward movement of the standing valve in the landing nipple. The standing valve may be retrieved back to surface or expended downwardly out of the landing nipple by applying weight on the standing valve or pumping down the conduit to release the standing valve ring to move to retracted position.

An object of this invention is to provide a system for controlling flow in a conduit which permits upward flow and prevents downward flow in the conduit.

An object of this invention is to provide a system for controlling flow in a conduit wherein a standing valve is installed in a landing nipple and the standing valve may later be retrieved or expended downwardly from the landing nipple.

Also an object of this invention is to provide a system for controlling flow in a conduit wherein the standing valve installed in the landing nipple requires substantial upward flow volume through to move the standing valve upward from the landing nipple.

DESCRIPTION OF THE PREFERRED EMBODIMENT

Figure 1:
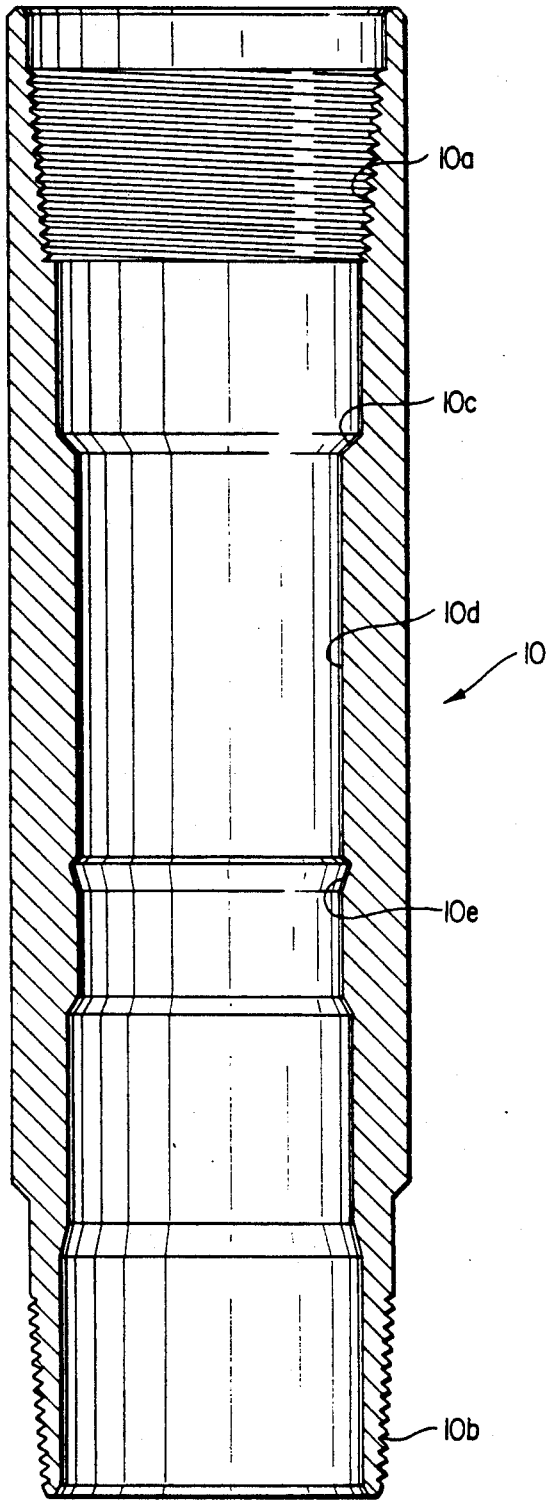
FIG. 1 is a sectional drawing in elevation of the landing nipple used in the system of this invention.

FIG. 1 shows the landing nipple 10 of the system of this invention, which has upper and lower connections 10*a* and 10*b* for connection into a well flow conduit, an internal landing shoulder 10*c*, a seal bore 10*d* and a profiled groove 10*e*.

Figure 2:
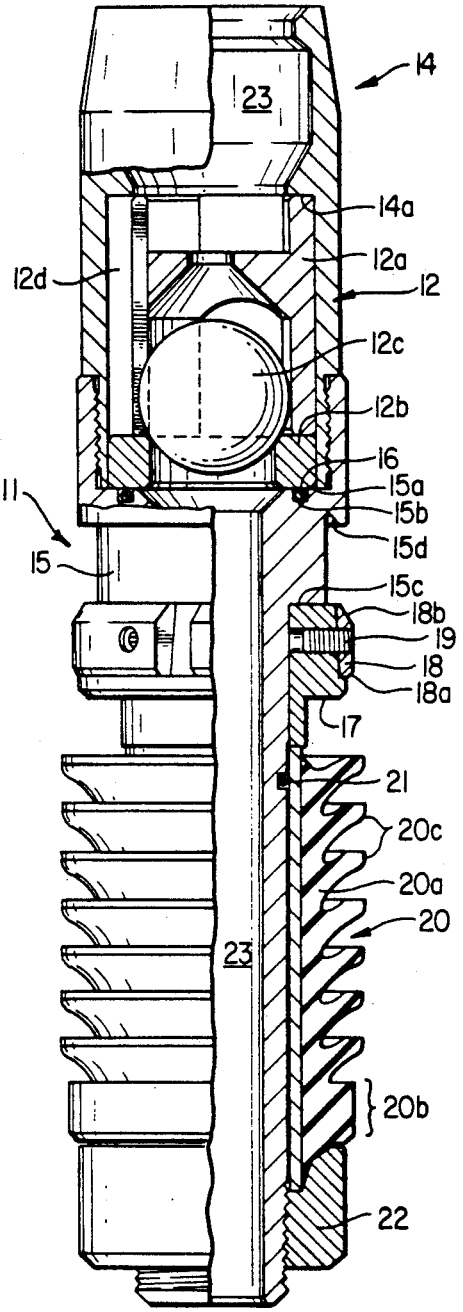
FIG. 2 is a partially sectioned drawing in elevation of the standing valve useful in the invention system.

FIG. 2 shows the standing valve 11 of the invention system. Valve 11 has a fishing neck 14 which is connected to valve body 15. A check valve 12 is retained between the fishing neck shoulder 14*a* and body shoulder 15*a*. Groove 15*b* in the body shoulder houses a resilient seal 16 which seals between the seat and body.

Figure 4:
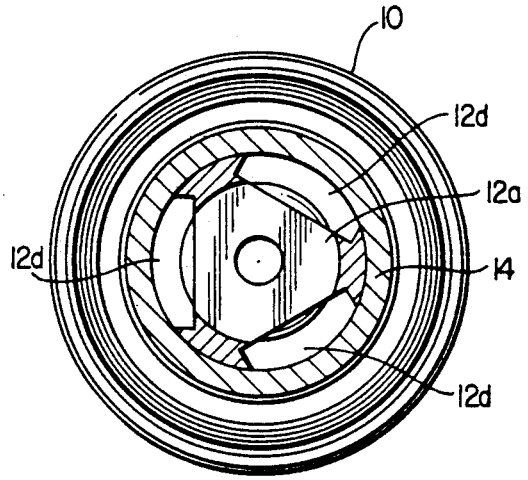
FIG. 4 is a partially cross sectioned drawing viewed along line 4—4 in FIG. 3.

Check valve 12 includes a cage 12*a*, a seat 12*b* and a valve ball 12*c* captured between the seat and cage, which is sealingly engageable with the seat. The cage has a number of through flow passages 12*d* (See also FIG. 4).

A ring expander 17 is mounted around body 15 below body shoulder 15*c*. A "C" shaped spring ring 18 is releasably positioned in expanded position on the ring expander by shearable pins or screws 19. The spring ring has a landing surface 18*a* and a camming surface 18*b* which is engageable with a camming surface 15*d* on the body.

A piston unit 20 having a resilient portion 20*a*, which has a cylindrical section 20*b* and plurality of lips 20*c*, is mounted around the body and is sealed to the body with a resilient seal 21. A guide 22 is threaded on body 15 to retain the piston unit around the body. Valve 11 has a flow passage 23 for upward flow through.

Figure 3:
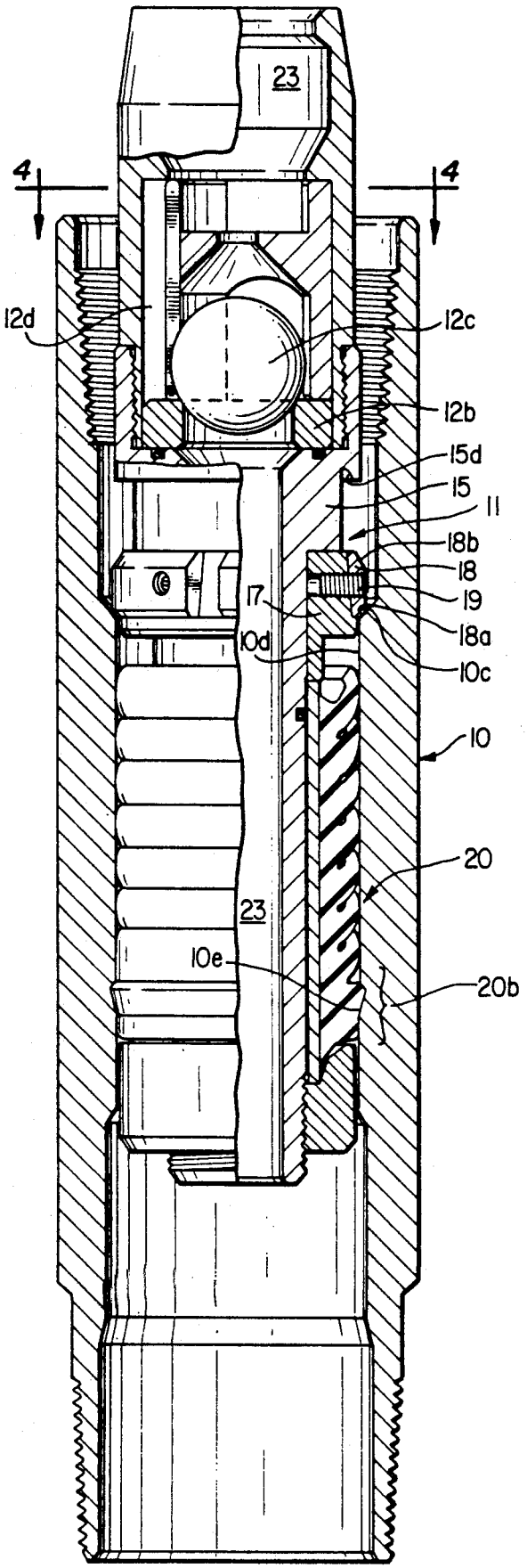
FIG. 3 is a partially sectioned drawing in elevation showing the standing valve installed in the landing nipple.

The well flow control system of this invention may be utilized in a well by connecting the landing nipple 10 in a well flow conduit at the desired level as the flow conduit is being lowered into the well. Valve 11 may be moved downwardly in the flow conduit by pumping, on reeled tubing or wireline for installation in the landing nipple. Piston lips 20*c* fold inwardly and slidably seal as valve 11 moves downwardly in the well conduit. As the diameter of resilient section 20*b* is greater than seal bore 10*d*, section 20*b* is compressed and slidably seals in seal bore 10*d* when Valve 11 is moved downwardly into the landing nipple. Downward movement of valve 11 into landing nipple 10 is stopped when ring landing surface 18*a* contacts nipple landing shoulder 10*c*. At that time, cylindrical section 20*b* is adjacent landing nipple profiled groove 10*e* and expands into the groove, as shown in FIG. 3.

Now, higher fluid pressure in the conduit above check valve ball 12*c* sealingly engages the ball on seat 12*b* and prevents downward flow through valve 11 and landing nipple 10. Conversely, higher pressure below valve ball 12*c* in flow passage 23 lifts the valve ball to permit upward flow through cage flow passages 12*d* and passage 23 in valve 11.

Upward frictional and impingement forces developed by upward flow in flow passage 23 will tend to push valve 11 upwardly out of landing nipple 10. Piston section 20*b* has expanded into nipple groove 10*e* and folded piston lips 20*c* are pressing outwardly in nipple bore 10*d* developing frictional forces retaining valve 11 in the landing nipple. A substantial upward flow volume is necessary to develop sufficient upward forces to overcome forces retaining the valve in the landing nipple and "flow" valve 10 upwardly from nipple 11.

Valve 11 may now be retrieved from landing nipple 10 back to surface or expended downwardly from the landing nipple. To expend, downward force is applied on valve 11 in the form of weight or pumping fluid down the well conduit, which causes check valve ball 12*c* to sealingly engage seat 12*b*. Ring landing surface 18*a* is supported by nipple shoulder 10*c* and increased weight or pressure will shear screws 19 and move valve 11 downward and out of the lower end of nipple 10. As ring supply 17 moves down through ring 18, the ring retracts around body 15 and surface 18*b* may contact surface 15*d* to retain ring 18 retracted.

What I claim is:

1. A standing valve having a through flow passage comprising:

(a) a body having a fishing neck;

(b) check valve means in said flow passage for permitting upward flow and preventing downward flow through said flow passage;

(c) retractible landing ring means on said body, said landing ring means including: a retracting camming surface on said body, a support ring mounted around said body, a spring ring positioned in expanded position around said support ring by at least one shearable pin through said spring ring into said support ring, said spring ring having a landing surface and a camming surface engageable with said retracting camming surface, said spring ring moveable to a retracted position; and (d) sealing means sealed around said body, said sealing means including a resilient section having a plurality of lips and a cylindrical section.

2. A standing valve having a through flow passage comprising:

(a) a body having a fishing neck;

(b) check valve means in the flow passage for permitting upward flow and preventing downward flow through said flow passage, said check valve means including:

a seat around said flow passage, said seat sealed in said body;

a valve ball sealingly engageable with said seat; and a cage having at least one through flow passage above said ball, said cage retaining said valve ball in said flow passage;

(c) retractible landing ring means on said body, said landing ring means including:

a retracting camming surface on said body, a support ring mounted around said body, a spring ring having a landing surface and a camming surface engageable with said retracting camming surface on the body, said spring ring releasably positioned in expanded position around said support ring by at least one shearable pin through said spring ring into said support ring and said spring ring moveable to a retractible position; and (d) sealing means sealed around said body, said sealing means including a resilient section having a plurality of lips and a cylindrical section.

* * * * *